US007762681B2

(12) United States Patent
Peckham, Jr.

(10) Patent No.: US 7,762,681 B2
(45) Date of Patent: Jul. 27, 2010

(54) SKATE COVERING WITH INTEGRAL, DOWNWARDLY PROJECTING LED ILLUMINATION SYSTEM

(76) Inventor: Alfred H. Peckham, Jr., P.O. Box 82, Ingalls, IN (US) 46048

( * ) Notice: Subject to any disclaimer, the term of this patent is extended or adjusted under 35 U.S.C. 154(b) by 0 days.

(21) Appl. No.: 12/247,296

(22) Filed: Oct. 8, 2008

(65) Prior Publication Data

US 2009/0034237 A1 Feb. 5, 2009

Related U.S. Application Data

(63) Continuation of application No. 11/517,980, filed on Sep. 8, 2006, now abandoned.

(51) Int. Cl.
*A63C 17/26* (2006.01)

(52) U.S. Cl. ..... 362/103; 280/11.203; 280/811; 362/249.02

(58) Field of Classification Search ..... 362/103, 362/249.02; 280/11.203, 811
See application file for complete search history.

(56) References Cited

U.S. PATENT DOCUMENTS 3,806,145 A * 4/1974 Czeiszperger ..... 280/811
5,437,466 A * 8/1995 Meibock et al. ..... 280/11.202
5,513,080 A * 4/1996 Magle et al. ..... 362/103
5,552,971 A * 9/1996 Madden ..... 362/459
5,933,987 A * 8/1999 Demarchi ..... 36/115
6,332,692 B1 * 12/2001 McCurdy ..... 362/103
7,059,739 B2 * 6/2006 Wong ..... 362/103

* cited by examiner

*Primary Examiner*—Jong-Suk (James) Lee
*Assistant Examiner*—Robert J May
(74) *Attorney, Agent, or Firm*—Bruce J. Bowman

(57) ABSTRACT

A covering for a skate incorporates a downwardly-directed LED illumination system. The covering is configured to wrap around and/or cover at least the lower portion of the shoe of the skate and may be formed of a flexible material such as cloth, or may be formed of a rigid or semi-rigid material such as a plastic or the like. The LED illumination system includes a first mount situated on a bottom side of the covering so as to be essentially parallel with a skating surface when the covering is situated on the skate and a second mount situated on another bottom side of the covering so as to be essentially parallel with the skating surface when the covering is situated on the skate. Each mount carries a plurality of LEDs so that the LEDs direct emanating light downward onto the skating surface. Circuitry, including a battery, switch and operating components/circuitry/logic, are carried on the inside of the covering and controls the lighting and/or lighting effects of the LEDs. The LEDs may be white, a single color, multiple colors, or any combination thereof.

20 Claims, 7 Drawing Sheets

SKATE COVERING WITH INTEGRAL, DOWNWARDLY PROJECTING LED ILLUMINATION SYSTEM

RELATED APPLICATIONS

This patent application is a continuation of U.S. patent application Ser. No. 11/517,980 filed Sep. 8, 2006 now abandoned entitled "Skate Covering With Integral, Downwardly Projecting LED Illumination System", the entire contents of which is specifically incorporated herein by reference and of which is claimed the benefit of and/or priority thereto.

BACKGROUND OF THE INVENTION

1. Field of the Invention

The present invention relates to illumination devices for skates and, more particularly, to a covering for a roller skate that incorporates a downwardly-directed LED illumination system.

2. Background Information

From roller skating to in-line skating to even ice skating, skating is a fun and healthful recreation and/or sport for many adults and children. Skating of all types is gaining in popularity especially because of the recognition of the healthful benefits such activity can bring. With popularity comes ingenuity. Some of such ingenuity has been directed towards providing illumination for skates.

Illumination can provide visual imagery for the skater and for people watching the skater. It can also provide aesthetic enhancement for the skater and/or skate. Moreover, illumination provides a safety factor when used at night. Because of this, various illumination systems have been developed for skates as well as other items such as skateboards, shoes, headbands and gloves.

However, with respect to skates, there are a number of prior art devices that are designed to provide illumination. For instance, U.S. Patent Publication 2004/0125595 by Salatino shows a skate light assembly that is interposed between a boot and the roller track of the skate. The skate light assembly includes a front light and rear light, with the rear light also being a switch. The front light directs light toward the front of the skate while the rear light directs light toward the rear of the skate. U.S. Pat. No. 6,238,055 issued to Wallace shows a powered lighting device for in-line skates and other sporting equipment wherein a battery case holding batteries is attached around the ankle of the skate. A flexible tube is attached to the battery case at one end and to a socket having a light bulb at the other end. The socket is affixed to the side of the skate shoe with a hook and loop material. The light bulb provides a forward directed light. Furthermore, U.S. Pat. No. 5,588,734 issued to Talamo et al. shows a side light for an in-line roller skate. The side light includes a battery housing that is attached around the ankle of the skate and includes a transparent tube holding a plurality of light elements. The tube is attached the side of the wheel mount and include a front light as well as a plurality of side lights. The plurality of side lights provides side illumination of the skating surface. Moreover, U.S. Pat. No. 5,516,149 issued to Moore shows a skate light apparatus that includes a self-contained, battery powered light assembly and an adjustable bracket or an adjustable strap for connecting the light assembly to the skate. The light assembly includes a housing, battery pack, a light source, and a switch. The light assembly may also include a rotatable reflector and an electric motor for rotating the reflector.

Further examples of lighting systems include U.S. Pat. No. 5,513,080 issued to Magle et al. Magle provides an indirect lighting system for roller skates and skateboards. The lighting system is mounted under the shoe section of the skate or on the underside of the skateboard for directing light down from the bottom of the skate/board onto the skating surface. U.S. Pat. No. 5,484,164 issued to McInerney et al. shows an illumination system for roller skates, roller blades (in-line skates) or the like, that has a battery pack mounted to the back of the skate boot and a plurality of lights mounted along the side of the boot between a front headlight and a rear brake light. The lights are integral with the skate boot. The brake light is operable through the brake pad of the skate. The circuit wires may be embedded in the boot. Lastly, U.S. Pat. No. 4,367,515 issued to Beard shows a roller skate light attachment that is operable to be fitted between the toe stop and the toe stop support.

A problem with some of these prior art lighting systems is that they are integral with the skate. Therefore, since they are permanently a part of the skate, they cannot be removed in order to transfer the lighting system to another skate if desired. Moreover, this complicates the ability to repair the lighting system if something should go wrong.

A problem with other skate lighting systems is that they are either attached to the skate in an awkward manner or have components or elements that extend beyond the perimeters of the skate. In both instances, such lighting systems may be easily damaged during normal use. Moreover, such lighting systems can easily become detached from the skate.

In still other cases, the lighting system is more akin to a headlight on a vehicle rather than being aesthetically pleasing in nature.

It is therefore evident from the above that there is a need for a skate lighting/illumination system that can be easily removed and/or transferred to another skate.

It is therefore also evident from the above that there is a need for a skate lighting/illumination system that eliminates or reduces the chance of breakage during use.

It is therefore further evident from the above that there is a need for a skate lighting/illumination system that provides illumination on the skate in an aesthetically pleasing manner.

SUMMARY OF THE INVENTION

The present invention is a covering for a skate having an integral, downwardly projecting LED illumination system. The covering is configured to wrap around and/or cover the shoe of the skate and may be formed of a flexible material such as cloth, or may be rigid or semi-rigid and formed of a plastic or the like. The LED illumination system includes a first mount situated on a bottom side of the covering so as to be essentially parallel with a skating surface when the covering is situated on the skate and a second mount situated on another bottom side of the covering so as to be essentially parallel with the skating surface when the covering is situated on the skate. Each mount carries a plurality of LEDs so that the LEDs direct emanating light downward onto the skating surface. Circuitry to drive and/or run the LEDs, including a battery and switch, are carried on the inside of the covering and controls the lighting and/or lighting effects of the LEDs.

In one form, the present invention provides a covering for a skate that includes a body formed to cover a shoe portion of a skate, a first board carried on a first bottom side of the body and parallel to a skating surface when the body is situated onto the skate, a first plurality of LEDs carried on the first board and situated thereon to direct light emanating therefrom downwardly toward the skating surface, a second board carried on a second bottom side of the body and parallel to the skating surface when the body is situated onto the skate, a second plurality of LEDs carried on the second board and situated thereon to direct light emanating therefrom downwardly toward the skating surface, and circuitry connected to the first and second plurality of LEDs and adapted to drive the first and second plurality of LEDs.

The present invention will be more apparent upon reading the following detailed description in conjunction with the accompanying drawings.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Like reference numerals indicate the same or similar parts throughout the several figures.

DETAILED DESCRIPTION OF THE PREFERRED EMBODIMENTS

Figure 1:
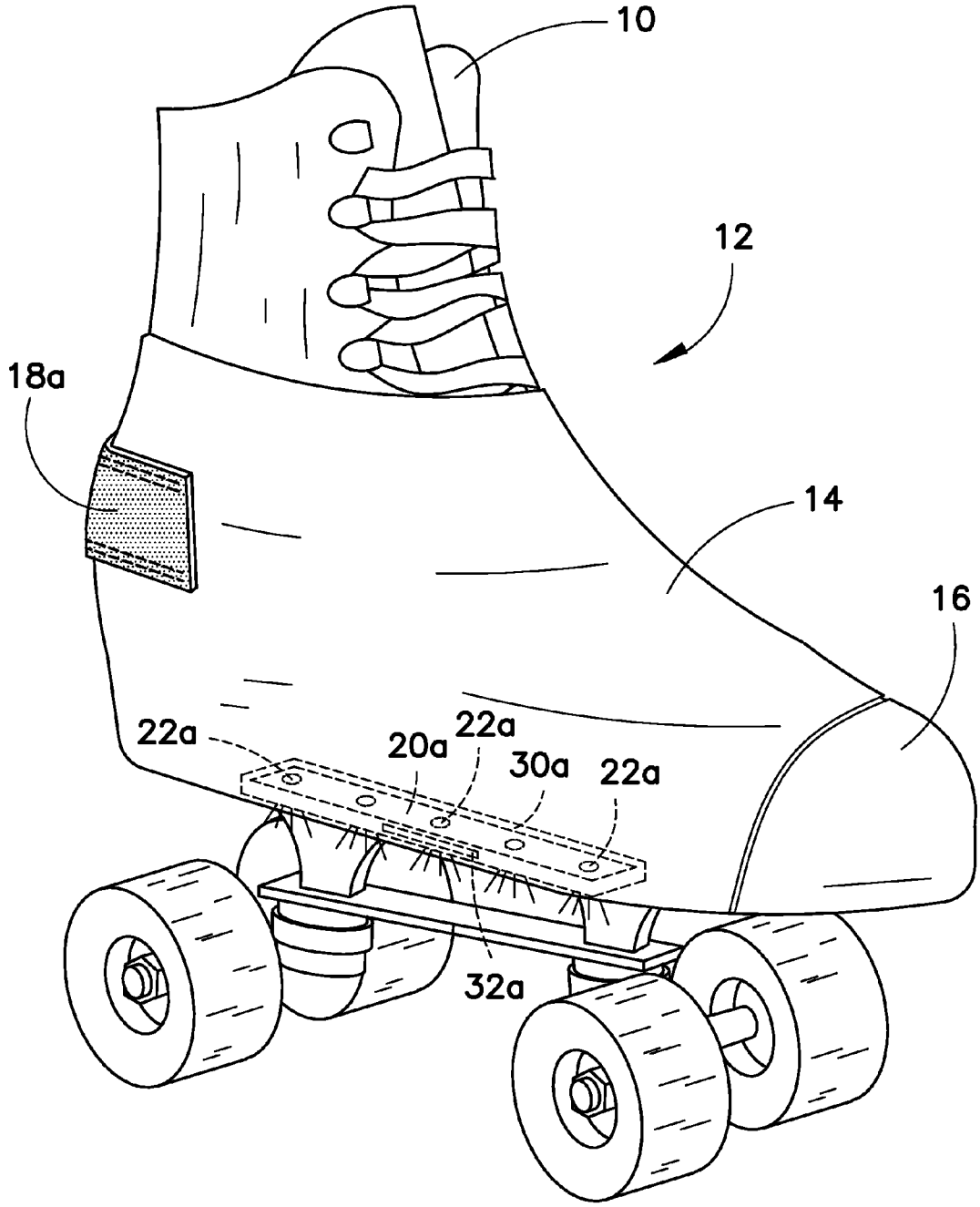
FIG. 1 is a perspective view of a roller skate having an exemplary embodiment of a skate covering with an integral, downwardly projecting LED illumination system fashioned in accordance with the present principles.
Figure 2:
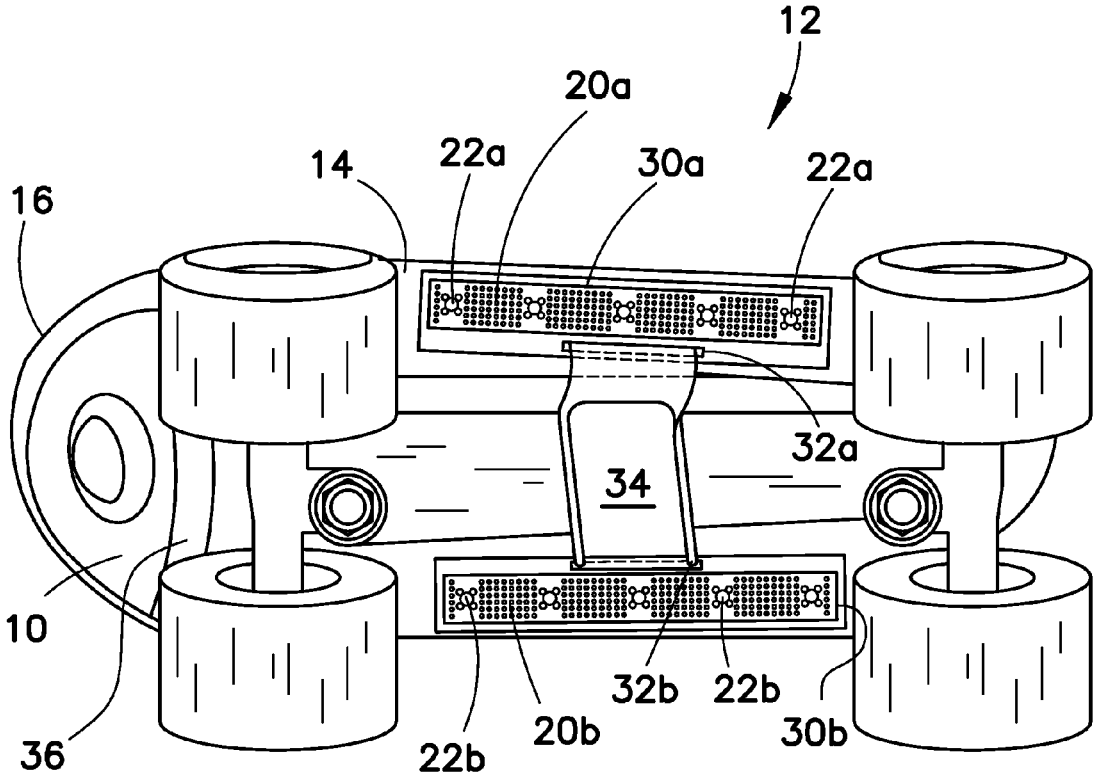
FIG. 2 is a bottom view of the roller skate of FIG. 1 having the present exemplary skate covering with the integral, downwardly projecting LED illumination system thereon particularly illustrating a manner in which the covering is retained onto the skate.
Figure 3:
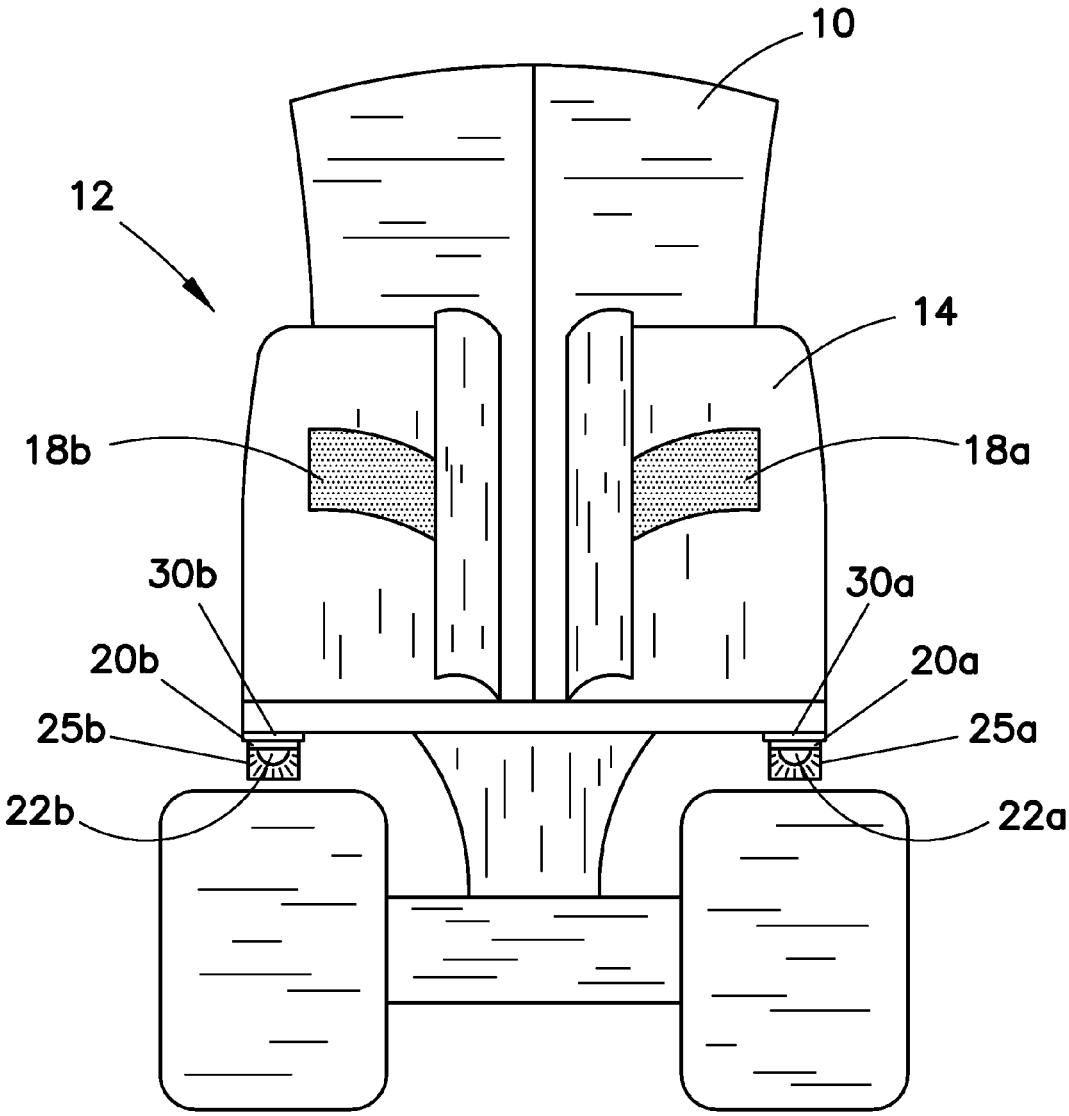
FIG. 3 is a rear view of the roller skate of FIG. 1 having the present exemplary skate covering with the integral, downwardly projecting LED illumination system thereon particularly illustrating a manner in which the covering is retained onto the skate.

Referring to FIGS. 1-3, there is depicted a typical roller skate 10 on which is disposed a skate covering with an integral, downwardly projecting LED illumination system, generally designated 12, fashioned in accordance with the present principles. The skate covering 12 is configured, adapted and/or operable to provide, in addition to other features, aesthetically pleasing illumination emanating from the underside of the skate 10. Particularly, the skate covering 12 provides downwardly projecting illumination or light of one or more colors, of white light, or a combination thereof as desired from right and left undersides of the skate.

Figure 4:
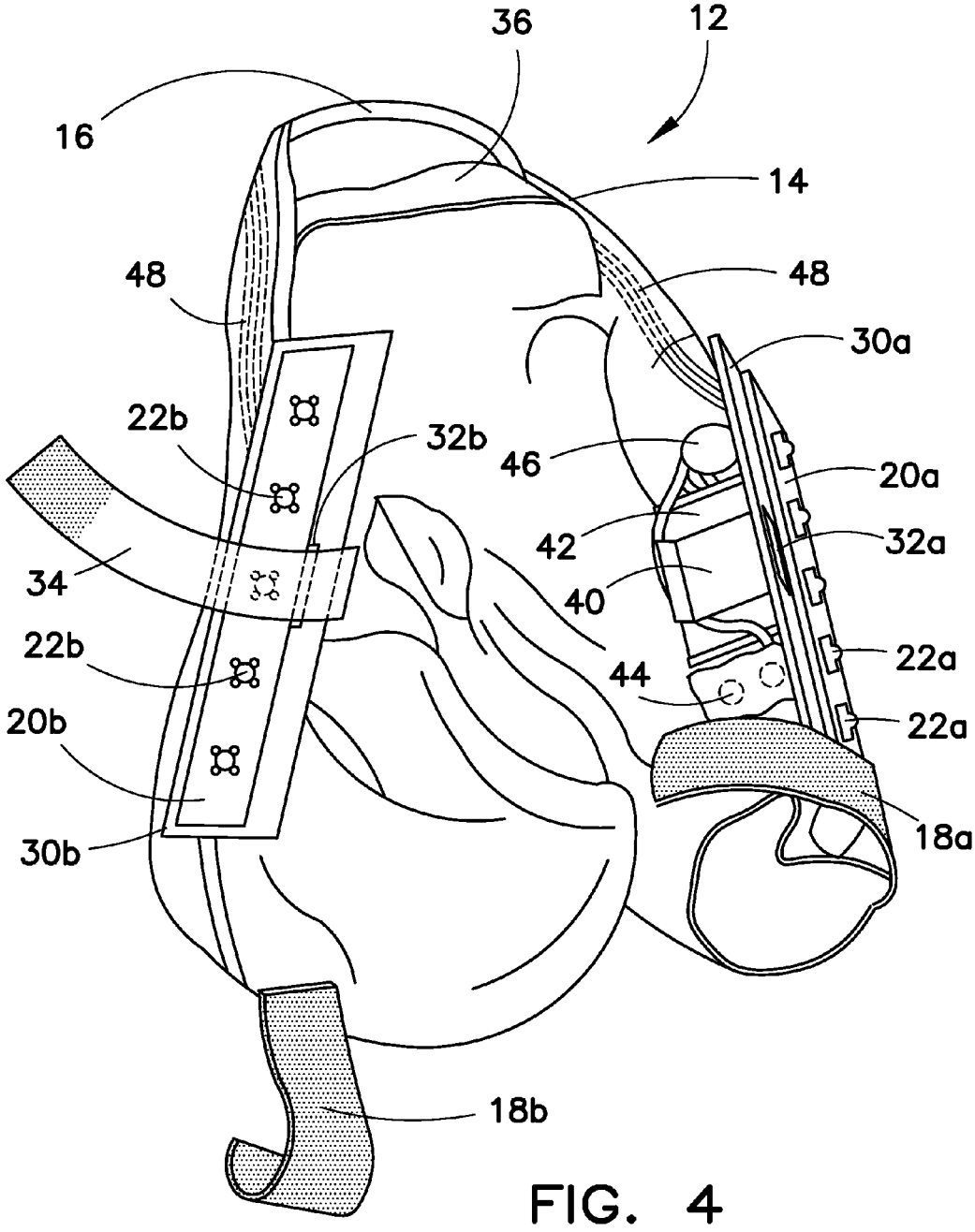
FIG. 4 is a perspective underside view of the present exemplary skate covering with the integral, downwardly projecting LED illumination system.

With additional reference to FIG. 4, the covering 12 is defined by a body 14 that, in this embodiment, is fabricated from a flexible material such as cloth. The cloth may also be somewhat stretchable if desired. The body 14 is designed to extend about the shoe portion of the skate 10. Since there are different sizes of skates, the body 14 may be come in different sizes in order to accommodate different sizes of skates. Because the body 14 is made from a cloth or cloth-like material, the covering 12 may include a toe guard 16 that covers the toe area of the covering 12 and thus the toe area of the shoe of the skate 10. The toe guard 16 may be fabricated from a relatively hard and/or durable material such as a plastic or similar material.

The covering 12 is designed to fit over the shoe of the skate 10 in a toe first manner. Particularly, the toe portion of the body 14 is slipped over the toe portion of the skate shoe and then fastened at the rear or heel of the skate shoe. As best seen in FIG. 2, the body 14 extends over the end of the toe of the shoe of the skate. FIGS. 2 and 4 show an optional toe strap 36 that is configured to fit underneath the toe of the shoe of the skate and beyond the toe stop thereof and which aids in retaining the front or toe part of the covering 12 onto the front part or toe of the shoe of the skate. FIG. 3 illustrates the closing of the rear of the covering 12. Particularly, the rear of the body 14 includes straps 18*a*, 18*b* that preferably, but not necessarily, each have a portion of a hook and loop material such as Velcro® that allows the straps 18*a*, 18*b* to be releasably attached to one another. The straps 18*a*, 18*b* may be fastened together in other manners. Additionally, the rear of the body 14 may not have straps but incorporate a closure mechanism. In FIG. 3, the rear of the covering 12 is shown before closure. In this manner, the covering 12 is retained on the shoe of the skate 10.

FIG. 2 depicts the bottom left and right sides of the covering 12 as the covering 12 fits around and onto the left and right bottom sides of the skate 10. The bottom left side of the covering includes a mount 30*a* that extends between the front and rear skate wheels. The mount 30*a* is rigid and may be fabricated from a plastic, plexi-glass or the like. The mount 30*a* includes a slot 32*a* that retains one end of a bottom strap 34. The bottom right side of the covering includes a mount 30*b* that extends between the front and rear skate wheels preferably, but not necessarily, in like manner to mount 30*a*. The mount 30*b* is rigid and may be fabricated from a plastic, plexi-glass or the like. The mount 30*b* includes a slot 32*b* that is sized, adapted and/or configured to receive the other end of the strap 34 therethrough. The strap 34 has hook and loop material (e.g. Velcro®) thereon that allows the end of the strap 34 to be attached to itself when looped around the slot 32*b* and back towards slot 32*a*. In this manner, the bottom sides of the body 14 are held together underneath the skate 10.

In accordance with the principles of the present invention, the covering 12 includes a first circuit board 20*a* that is carried on the mount 30*a* on the bottom left side of the body 14 and a second circuit board 20*b* carried on the mount 30*b* on the bottom right side of the body 14. The circuit board 20*a* has a plurality of LEDs 22*a* situated along its length. While five (5) LEDs are shown, it should be appreciated that the number of LEDs may vary. In like manner, the circuit board 20*b* has a plurality of LEDs 22*b* situated along its length. Again, while five (5) LEDs are shown, it should be appreciated that the number of LEDs may vary. Also, the number of LEDs may be the same on each circuit board or may be different. The LEDs 22*a*, 22*b* may emit white light, a single color of light, or any combination of white and/or colored light. The LEDs 22*a*, 22*b* may also be multi-colored LEDs such as are known in the art. The circuit boards 20*a*, 20*b* have the necessary electrical components, circuitry, logic or the like to drive the LEDs. It should be appreciated that the LEDs 22*a*, 22*b* may be mounted onto something other than a circuit board or rigid mount. For instance, the LEDs may be mounted directly onto the material of the body of the covering.

As best seen in FIG. 4, a battery 42 retained in a battery clip 40 is used as a source of electricity and is disposed on the inside of the body 14. The battery 42 is shown as a typical nine (9) volt battery. It should be appreciated that other types, styles and/or voltages of batteries and/or more than one battery may be used to power the LEDs. The circuitry for the LEDs is adapted to utilize the chosen battery or batteries. The LEDs 22*a*, 22*b* are thus driven by DC voltage. A switch 46 is provided in the circuitry to turn the LEDs on and off. Wires 48 emanate from the circuitry/circuit board 20*a* and extend around the body 14 to connect to the circuitry/circuit board 20*b*. Preferably, and as shown, the wires 48 are sewn into or are provided within an inside covering of the body 14 in order to hide and/or protect the wires 48.

In one form, the circuitry/logic that drives the LEDs 22*a*, 22*b* functions to continuously light all of the LEDs 22*a*, 22*b* once turned on. Alternatively or additionally, the circuitry/logic may provide various modes of lighting of the LEDs 22*a*, 22*b*. Such modes of lighting may provide for continuous flashing of all or certain ones of the LEDs such as by color and/or position. Another mode may be a running or sequence mode whereby a first to last LED is turned on then off, and then repeats itself. Other modes may be derived from a combination of the above as well as other sequences as desired. Other modes are contemplated. Any one or all of these modes may be done for each bank of LEDs 22*a* and 22*b* at the same time or alternately.

FIG. 3 depicts an optional cover 25*a* that is situated over the LEDs 22*a*. The cover 25*a* is formed of a translucent or semi-translucent material in order to allow the light from the LEDs 22*a* to be seen there the cover 25*a*. The cover 25*a* extends from and along the mount 30*a*. Likewise, an optional cover 25*b* is depicted that is situated over the LEDs 22*b*. The cover 25*b* is formed of a translucent or semi-translucent material in order to allow the light from the LEDs 22*b* to be seen there the cover 25*b*. The cover 25*b* extends from and along the mount 30*b*. The covers 25*a*, 256*b* are not shown in FIG. 4 for clarity.

Figure 5:
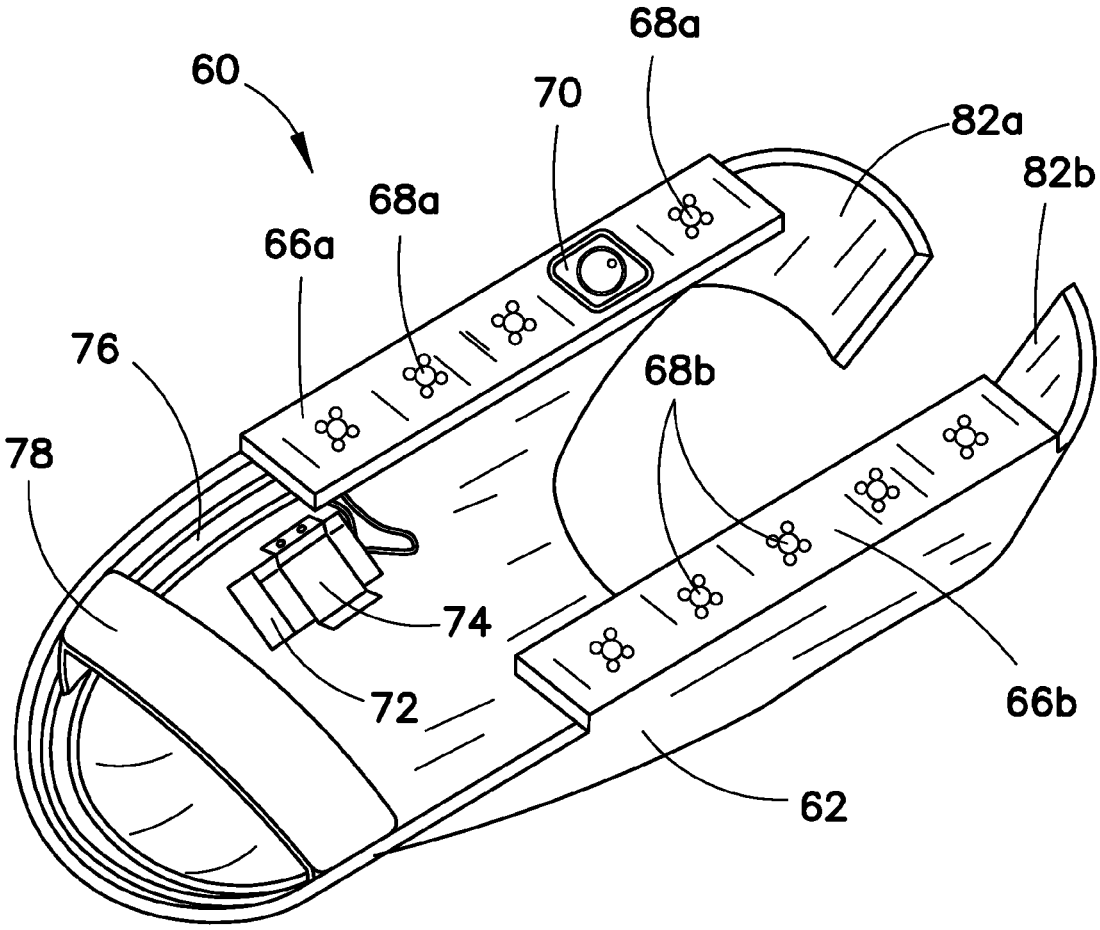
FIG. 5 is a perspective underside view of another exemplary skate covering with an integral, downwardly projecting LED illumination system fashioned in accordance with the present principles.

Referring now to FIG. 5, there is shown another embodiment of a covering 60 fashioned in accordance with the present principles. The covering 60 includes a rigid or semi-rigid body 62 that is shaped as a skate shoe. The body 62 may be thus formed of a flexible or rigid material such as plastic or the like. A toe strap 78 may be provided to help hold the body 62 onto the skate shoe. The body 62 has a left circuit board/mount 66*a* that extends transversely from a bottom left side of the body 62, and a right circuit board/mount 66*b* that extends transversely from a bottom right side of the body 62. The mounts 66*a* and 66*b* may be formed of the same material as the body 62 or may be formed of another material if desired. The back or heel of the body 62 is open to form a left end flap 82*a* and a right end flap 82*b*. The left and right end flaps 82*a*, 82*b* preferably, but not necessarily, include a closure mechanism to hold the flaps 82*a*, 82*b* together and retain the covering 60 onto the skate 10.

The mount 66*a* carries a plurality of LEDs 68*a* and an on/off switch 70. The mount 66*b* carries a plurality of LEDs 68*b*. While four (4) LEDs are shown on mount 66*a*, it should be appreciated that the number of LEDs may vary. The mount 66*b* has five (5) LEDs which is different in number than the number of LEDs 66*a* carried on the mount 66*a*. It should be appreciated that the number of LEDs may vary. The LEDs 66*a*, 66*b* may emit white light, a single color of light, or any combination of white and/or colored light. The LEDs 66*a*, 66*b* may also be multi-colored LEDs such as are known in the art. The circuit boards 60*a*, 60*b* have the necessary electrical components, circuitry, logic or the like to drive the LEDs. Moreover, while not shown in the embodiment of FIG. 5, covers like the covers 25*a*, 25*b* for the covering 12, may be situated over the LEDs 68*a*, 68*b*. Alternatively, the LEDs 68*a*, 68*b* may be recessed mounted in the mounts 66*a*, 66*b* with or without a cover for protection thereof. This may also apply to covering 12.

The underside of the body 62 carries a battery 72 retained in a battery clip 72 that is used as a source of electricity. The battery 72 is shown as a typical nine (9) volt battery. It should again be appreciated that other types, styles and/or voltages of batteries and/or more than one battery may be used to power the LEDs. The circuitry for the LEDs is adapted to utilize the chosen battery or batteries. The LEDs 66*a*, 66*b* are thus driven by DC voltage. Wires 76 emanate from the circuitry/circuit board/mount 60*a* and extend around the body 62 to connect to the circuitry/circuit board/mount 60*b*. Preferably, and as shown, the wires 48 are formed into or are provided within an inside covering of the body 62 in order to hide and/or protect the wires 76.

In one form, the circuitry/logic that drives the LEDs 66*a*, 66*b* functions to continuously light all of the LEDs 66*a*, 66*b* once turned on. Alternatively or additionally, the circuitry/logic may provide various modes of lighting of the LEDs 66*a*, 66*b*. Such modes of lighting may provide for continuous flashing of all or certain ones of the LEDs such as by color and/or position. Another mode may be a running or sequence mode whereby a first to last LED is turned on then off, and then repeats itself. Other modes may be derived from a combination of the above as well as other sequences as desired. Other modes are contemplated. Any one or all of these modes may be done for each bank of LEDs 66*a* and 66*b* at the same time or alternately.

Figure 6:
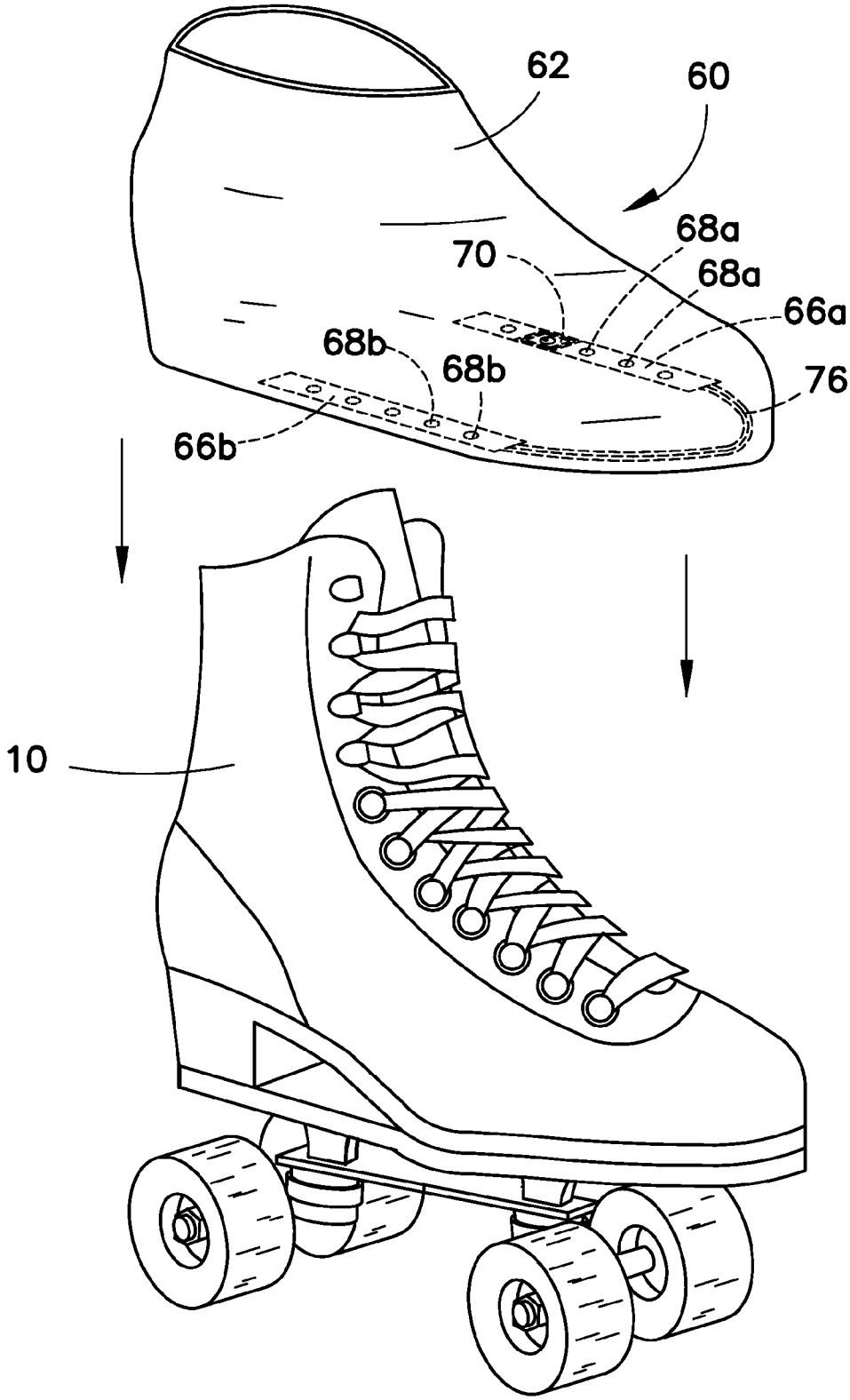
FIG. 6 is a perspective view of the skate covering with integral, downwardly projection LED illumination system of FIG. 6 illustrating a manner in which the skate covering is placed on a roller skate.

FIG. 6 depicts the manner in which the covering 60 is placed or received onto the skate 10. Because the covering 60 is rigid or at least semi-rigid, it fits down over the skate shoe. The toe of the body 62 is received over the toe of the shoe of the skate 10 while the back of the body 62 is closed around the heel of the skate 10.

Figure 7:
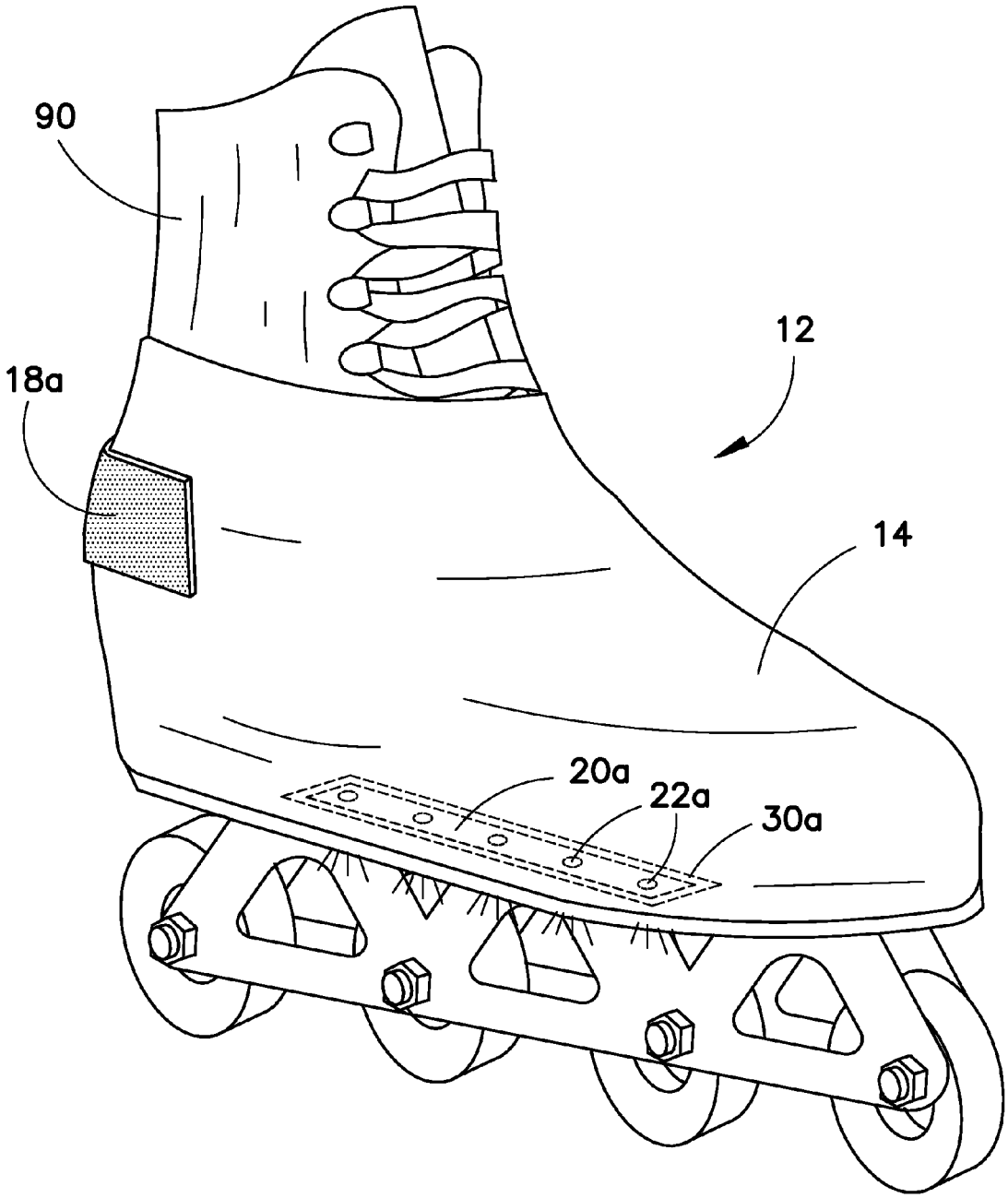
FIG. 7 is a perspective view of an in-line skate having a skate covering with an integral, downwardly projection LED illumination system fashioned in accordance with the present principles.

It should be appreciated that while not shown, the present LED skate covering may be used on other types of skates such as in-line skates, ice skates or the like. For example, FIG. 7 depicts the skate covering 12 on an in-line skate. The covering 12 is also shown without a protective toe piece or cover.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

What is claimed is:

1. An illumination system for a skate, the illumination system comprising:

a body formed to removably cover and entirely surround an outside surface of a skate, the body having a continuous undersurface that lies below a shoe portion of the skate when the body is situated on the skate, the continuous undersurface defining a first bottom side that is parallel to a skating surface on a first side of the skate, and a second bottom side that is parallel to the skating surface on a second side of the skate, the first and second bottom sides extending from proximate a toe portion of the body to proximate a heel portion of the body;

a first elongated circuit board integral with the first bottom side of the body and extending between the toe portion of the body and the heel portion of the body, the first elongated circuit board parallel to a skating surface when the body is situated onto the skate;

a first plurality of LEDs carried on the first elongated circuit board and situated thereon to direct light emanating therefrom downwardly toward the skating surface;

a second elongated circuit board integral with the second bottom side of the body and extending between the toe portion of the body and the heel portion of the body, the second elongated circuit board parallel to the skating surface when the body is situated onto the skate;

a second plurality of LEDs carried on the second elongated circuit board and situated thereon to direct light emanating therefrom downwardly toward the skating surface;

circuitry carried by the body and associated with the first and second elongated circuit boards, the circuitry providing connection to the first and second plurality of LEDs to drive the first and second plurality of LEDs; and a strap having a first end connected to one of the first and second bottom sides of the body and a second end that is connectable to the other one of the first and second bottom sides of the body in order to hold the body onto the skate.

2. The illumination system of claim 1, wherein the body is formed of cloth.

3. The illumination system of claim 2, further comprising a rigid guard formed on a toe portion of the body.

4. The illumination system of claim 1, wherein the body is formed of a rigid but pliable material.

5. The illumination system of claim 4, wherein the rigid but pliable material comprises a plastic.

6. The illumination system of claim 1, wherein the body is formed of a semi-rigid material.

7. The illumination system of claim 6, wherein the semi-rigid material comprises a plastic.

8. The illumination system of claim 1, wherein the first and second plurality of LEDs are all a same color.

9. The illumination system of claim 1, wherein the first and second plurality of LEDs are multiple colors.

10. The illumination system of claim 1, wherein the circuitry is adapted to provide various display modes of the first and second plurality of LEDs.

11. The illumination system of claim 1, further comprising a switch carried on an inside surface of the body and connected to the circuitry to turn the first and second plurality of LEDs on and off.

12. The illumination system of claim 1, wherein the first and second circuit boards extend between front and rear wheels of the skate.

13. An illumination system for a roller skate, the illumination system comprising:

a body configured to removably and completely cover an entire outside surface of a roller skate, the body having a continuous undersurface that lies below a shoe portion of the roller skate when the body is situated on the roller skate, the continuous undersurface defining a first bottom side that is parallel to a skating surface on a first side of the roller skate, and a second bottom side that is parallel to the skating surface on a second side of the roller skate, the first and second bottom sides extending from proximate a toe portion of the body to proximate a heel portion of the body;

a first elongated circuit board integral with the first bottom side of the body and extending between a first front wheel of a front wheel pair of the roller skate and a first back wheel of a back wheel pair of the roller skate and be parallel to a skating surface when the body is situated onto the outside surface of the roller skate;

a first plurality of LEDs operatively connected to the first elongated circuit board and situated thereon to direct light emanating therefrom downwardly toward the skating surface;

a second elongated circuit board integral with the second bottom side of the body and extending between a second front wheel of the front wheel pair of the roller skate and a second back wheel of the back wheel pair of the roller skate and be parallel to a skating surface when the body is situated onto the outside surface of the roller skate;

a second plurality of LEDs operatively connected to the second elongated circuit board and situated thereon to direct light emanating therefrom downwardly toward the skating surface;

circuitry carried by the body and associated with the first and second elongated circuit boards, the circuitry providing connection to the first and second plurality of LEDs to drive the first and second plurality of LEDs; and a strap having a first end connected to one of the first and second bottom sides of the body and a second end that is connectable to the other one of the first and second bottom sides of the body in order to hold the body onto the roller skate.

14. The illumination system of claim 13 wherein the body is formed of cloth.

15. The illumination system of claim 13, wherein the body is formed of a rigid but pliable material.

16. The illumination system of claim 13, wherein the body is formed of a semi-rigid material.

17. An illumination device for a roller skate comprising:

a removable sheath configured to wrap entirely about an outside surface a of a roller skate, the sheath having a continuous undersurface that lies below a shoe portion of the roller skate when the sheath is situated on the roller skate, the continuous undersurface defining a first bottom side that is parallel to a skating surface on a first side of the roller skate, and a second bottom side that is parallel to the skating surface on a second side of the roller skate, the first and second bottom sides extending from proximate a toe portion of the sheath to proximate a heel portion of the sheath;

a first lighting system integral with the first bottom side of the sheath and extending between the toe portion of the sheath and the heel portion of the sheath, the first lighting system carrying a first plurality of LEDs and configured to provide illumination of a skating surface;

a second lighting system integral with the second bottom side of the sheath and extending between the toe portion of the sheath and the heel portion of the sheath, the second lighting system carrying a second plurality of LEDs and configured to provide illumination of the skating surface;

circuitry carried by the sheath and connected to the first and second plurality of LEDs, the circuitry adapted to drive and power the first and second plurality of LEDs; and a strap having a first end connected to one of the first and second bottom sides of the sheath and a second end that is connectable to the other one of the first and second bottom sides of the sheath in order to hold the sheath onto the roller skate.

18. The illumination device of claim 17, wherein the sheath is fabricated from cloth.

19. The illumination device of claim 17, wherein the sheath is fabricated from a semi-rigid material.

20. The illumination device of claim 17, wherein the sheath is fabricated from a rigid but pliable material.

* * * * *